US008985967B2

(12) United States Patent
Gudivada

(10) Patent No.: US 8,985,967 B2
(45) Date of Patent: Mar. 24, 2015

(54) SOURCE OF POWER IN A HYDROCARBON WELL FACILITY

(75) Inventor: Gopalakrishna Gudivada, AndhraPradesh (IN)

(73) Assignee: Vetco Gray Controls Limited, Nailsea (GB)

( * ) Notice: Subject to any disclaimer, the term of this patent is extended or adjusted under 35 U.S.C. 154(b) by 281 days.

(21) Appl. No.: 13/593,062

(22) Filed: Aug. 23, 2012

(65) Prior Publication Data

US 2013/0052043 A1 Feb. 28, 2013

(30) Foreign Application Priority Data

Aug. 25, 2011 (EP) ..... 11178892

(51) Int. Cl.

| | |
|---|---|
| ***F04B 17/00*** | (2006.01) |
| ***F01D 1/04*** | (2006.01) |
| ***F04D 13/04*** | (2006.01) |
| ***E21B 41/00*** | (2006.01) |

(52) U.S. Cl.

CPC ..... *F04D 13/043* (2013.01); *E21B 41/0085* (2013.01)

USPC ... 417/408; 415/1; 415/77; 416/1; 416/193 R

(58) Field of Classification Search

CPC ..... F04D 13/043; E21B 41/0085

USPC ..... 417/408; 415/1, 77–79; 416/1, 193 R

See application file for complete search history.

(56) References Cited

U.S. PATENT DOCUMENTS

| | | | | |
|---|---|---|---|---|
| 2,436,683 | A | 2/1948 | Wood | |
| 2,906,447 | A * | 9/1959 | Seed | 417/352 |
| 3,667,864 | A * | 6/1972 | Murphy | 417/53 |
| 3,818,695 | A * | 6/1974 | Rylewski | 60/39.183 |
| 3,824,793 | A * | 7/1974 | Matthews | 60/641.4 |
| 4,134,024 | A * | 1/1979 | Wiseman | 290/52 |
| 4,318,004 | A | 3/1982 | Tsunoda | |
| 4,576,006 | A * | 3/1986 | Yamaoka | 60/641.5 |
| 4,913,631 | A * | 4/1990 | Vandendorpe | 417/355 |
| 5,295,810 | A * | 3/1994 | Heijnen | 417/408 |
| 5,839,508 | A | 11/1998 | Tubel et al. | |
| 6,011,334 | A | 1/2000 | Roland | |
| 6,273,680 | B1 | 8/2001 | Arnold | |
| 6,554,074 | B2 | 4/2003 | Longbottom | |
| 6,607,030 | B2 | 8/2003 | Bauer et al. | |
| 6,820,689 | B2 * | 11/2004 | Sarada | 166/266 |
| 7,002,261 | B2 | 2/2006 | Cousins | |
| 7,021,905 | B2 | 4/2006 | Torrey et al. | |
| 7,141,901 | B2 | 11/2006 | Spring | |

(Continued)

FOREIGN PATENT DOCUMENTS

| | | |
|---|---|---|
| DE | 833879 C | 3/1952 |
| DE | 102004031789 A1 | 11/2005 |

(Continued)

OTHER PUBLICATIONS

EP Search Report from corresponding EP Patent Application 11178892.3 Date as Feb. 3, 2012.

*Primary Examiner* — Charles Freay

(74) *Attorney, Agent, or Firm* — GE Global Patent Operation

(57) ABSTRACT

A rotor is provided. The rotor comprises external blades for use in causing rotation of the rotor, and internal blades for use in propelling a fluid through the rotor during rotation of the rotor.

8 Claims, 1 Drawing Sheet

(56) References Cited

U.S. PATENT DOCUMENTS

| | | | |
|---|---|---|---|
| 7,242,103 | B2 | 7/2007 | Tips |
| 7,560,856 | B2 | 7/2009 | Chen et al. |
| 7,579,703 | B2 | 8/2009 | Shifrin |
| 7,600,963 | B2 | 10/2009 | Miller |
| 7,633,178 | B1 | 12/2009 | Embree |
| 2003/0175109 | A1 | 9/2003 | Brock et al. |
| 2008/0238105 | A1 | 10/2008 | Ortiz et al. |
| 2009/0102193 | A1 | 4/2009 | Murphy |

FOREIGN PATENT DOCUMENTS

| | | | |
|---|---|---|---|
| EP | 2110546 | A2 | 3/2009 |
| FR | 725958 | A | 5/1932 |
| FR | 1142919 | A | 9/1957 |
| FR | 2822891 | A | 10/2002 |

* cited by examiner

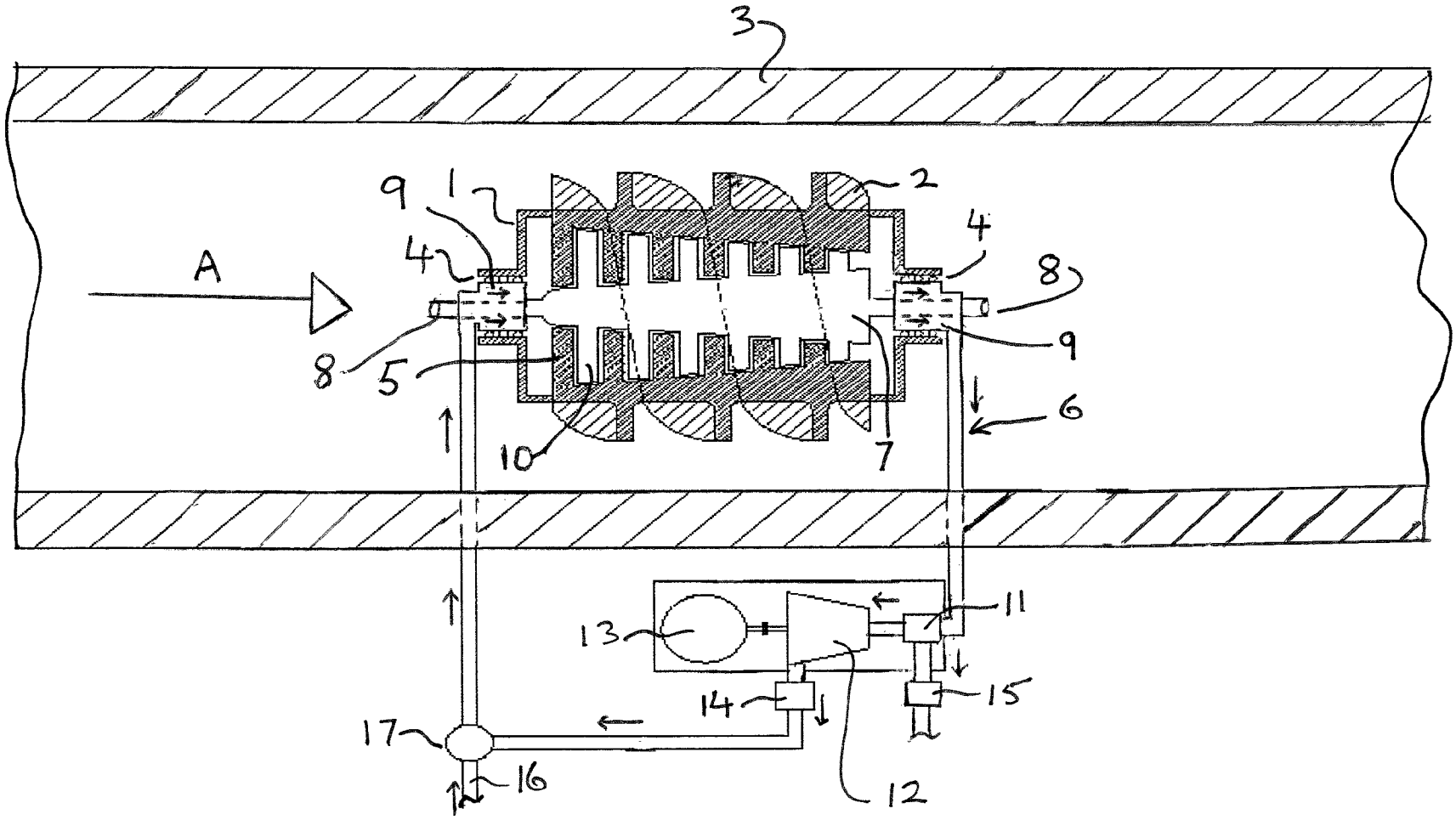
3
2
1
4
8
9
6
7
10
5
11
12
13
14
15
16
17
A

SOURCE OF POWER IN A HYDROCARBON WELL FACILITY

BACKGROUND OF THE INVENTION

Embodiments of the present invention relate to rotors, for example in apparatus providing a source of power, such as in a hydrocarbon well facility.

In offshore oil and gas production control systems, much of the control equipment is installed on the seabed. This subsea equipment essentially opens and closes subsea valves that control and allow the flow of hydrocarbon fluid from the well. Electrical power and hydraulic power required for operating the equipment and valves installed on the seabed is normally provided by an electrical power unit and a hydraulic power unit installed topside, either on a rig, floating platform or onshore. The electrical power is carried to the subsea equipment via an umbilical cable which also includes a communication link (that carries control and instrumentation signals) together with hydraulic pipelines which carry hydraulic fluid for electrically actuated hydraulic fluid operated control valves.

The umbilical cable may be several kilometers long and is heavy and expensive so its design is therefore critical. The cost of the umbilical cable in a typical subsea production system has been estimated to be as much as 40% of the overall cost of the complete subsea system and a cost effective design is therefore essential. A reduction in the amount of electrical power to be transmitted subsea will reduce the size, rating and cost of the electrical cables required in the umbilical cable. Similarly, a reduction in the amount or pressure of hydraulic fluid in the hydraulic pipes in the umbilical cable will result in significant savings.

BRIEF DESCRIPTION OF THE INVENTION

According to an embodiment of the present invention, a rotor is provided. The rotor comprises external blades for use in causing, rotation of the rotor, and internal blades for use in propelling a fluid through the rotor during rotation of the rotor.

According to another embodiment of the present invention an apparatus for providing a source of power is provided. The apparatus comprises a rotor having external blades for use in causing rotation of the rotor and internal blades for use in propelling a fluid through the rotor during rotation of the rotor. The apparatus further comprises a fluid circuit coupled with the rotor, wherein rotation of the rotor propels fluid in the fluid circuit through the fluid circuit. The apparatus also comprises a device configured to use the fluid propelled through the fluid circuit as a power source.

According to another embodiment of the present invention a method of propelling a fluid is provided. The method comprises providing a rotor having external blades and internal blades, and causing rotation of the rotor via the external blades to propel the fluid through the rotor during rotation of the rotor.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

BRIEF DESCRIPTION OF THE DRAWING

FIG. 1 shows schematically an embodiment of the invention.

DETAILED DESCRIPTION OF THE EXEMPLARY EMBODIMENTS OF THE INVENTION

FIG. 1 shows an application of an embodiment of the invention to generate hydraulic and/or electrical power by capturing some of the energy in hydrocarbon fluid flow in a subsea hydrocarbon well facility. The energy capturing device, which is installed in the hydrocarbon fluid flow, is a novel turbine type pump arrangement, which comprises two main parts as follows:

1) A rotor 1, shown in sectioned view, has on its outside aerofoil type blades 2 designed to optimise the capture of kinetic energy from the hydrocarbon fluid which flows through a production fluid pipeline 3 in the direction of arrow A. The rotor 1 is mounted on bearings 4 at opposite ends and is free to rotate in the fluid flow. The rotor is positioned axially in the fluid flow to optimize the capture of energy. The hydrocarbon fluid forces the rotor 1 to rotate via the blades 2, generating rotational mechanical energy. The inside of the rotor 1 also has blades 5 which are used to propel hydraulic fluid in a second separate, hydraulic fluid circuit 6.
2) A fixed stator 7 in the rotor 1 defines a part of hydraulic fluid circuit 6 between itself and the rotor 1. The stator 7 is fixed within the production fluid pipeline 3 carrying the hydrocarbon fluid by mechanical mounts 8 carried by portions 9 of the circuit 6, the bearings 4 being between the rotor 1 and the portions 9. The stator 7 has blades 10 on its outside which effectively match and are interleaved with the blades 5 on the inside of the rotor 1. The volume between adjacent blades 5 and 10 decreases in the direction in which hydraulic fluid in circuit 6 is propelled between these blades. In this embodiment, this is achieved by the blades 5 and 10 decreasing in length in that direction.

When the rotor 1 rotates due to the flow of hydrocarbon fluid in pipeline 3, it forces and pumps hydraulic fluid in circuit 6 between the rotor blades 5 and stator blades 10, generating high fluid pressure. This fluid is then used as a power source in the subsea control system.

A control system controls the amount of hydraulic fluid pressure generated by the energy capturing device and channels the hydraulic fluid from circuit 6 via a valve 11 to wherever high pressure hydraulic fluid is required, such as a turbine 12 driving a generator 13 to generate electricity (hydraulic fluid leaving the turbine 12 via a valve 14) and/or for hydraulically operating at least one valve 15. Reference numeral 16 designates an input for supplying hydraulic fluid to circuit 6 as appropriate. The flow of hydraulic fluid is indicated by the small arrows in FIG. 1.

The embodiment of the invention relies on the availability of hydrocarbon fluid flow. Initializing of this fluid flow requires the operation of appropriate valves (such a valve 17 in FIG. 1) which will have to be powered and controlled from topside equipment via an umbilical cable. Alternatively, if subsea electric power is available from other sources, then only the control of the flow initialization may be needed via the umbilical cable.

According to an embodiment of the present invention, there is provided a stator in said rotor, so that said fluid can be propelled between said rotor and said stator. In this case, said stator has a plurality of external blades interleaved with said internal blades of the rotor so that rotation of the rotor causes said fluid to be propelled between said blades. Typically, the volume between adjacent internal and external blades decreases in the direction in which said fluid is propelled between said rotor and said stator, for example by the lengths of said internal and external blades decreasing in the direction in which said fluid is propelled between said rotor and said stator.

The rotor could be in a flow path for a second fluid, the rotor being rotatable by the flow of the second fluid through said path. In this case, the rotor could be in a flow path for hydrocarbon fluid in a hydrocarbon well facility, said using means using the fluid propelled through the circuit as a power source for the facility.

Said using means could comprise means for hydraulically operating at least one device and/or means for generating electrical power from fluid propelled through said circuit.

Typically, a fluid circuit is coupled with said rotor, rotation of the rotor propelling fluid in the circuit through the circuit and the fluid propelled through the circuit being used a power source.

The rotor could be in a flow path for a second fluid, the rotor being rotated by the flow of the second fluid through said path. In this case, the rotor could be in a flow path for hydrocarbon fluid in a hydrocarbon well facility, the fluid propelled through the circuit being used as a power source for the facility.

Propelled fluid could be used for hydraulically operating at least one device and/or used for generating electrical power.

An embodiment of this invention utilizes the kinetic energy in hydrocarbon fluid flowing from a well to generate local energy at the seabed which can be subsequently used to provide electrical power and/or some or all of the power necessary to operate subsea valves, thereby reducing the overall power needed to be transferred via the umbilical cable to the seabed equipment. In so doing, it will ease the requirement placed on the umbilical cable and provide a means of reducing the overall umbilical cost.

While it is known to provide a means of generating electricity by using the flow of hydrocarbon fluid to rotate the blades of a rotor attached to an electrical generator, this embodiment of the invention operates by capturing some of the kinetic energy from the hydrocarbon fluid and transferring it directly to pressurize a hydraulic system and provide power which can then be used to operate hydraulic devices such as valves and/or to drive a turbine driven generator to provide electrical power to drive actuators for example.

Embodiments of the present invention is not limited to the provision of hydraulic power but could be used to generate pneumatic power if required.

Embodiments of the present invention provide a means of generating local power at the seabed.

In addition, hydraulic and/or electrical power is available wherever hydrocarbon fluid is flowing.

Execution time for operating a valve is considerably reduced by using local hydraulic power (from command to closure) because supplying hydraulic power through the umbilical cable depends on the hydraulic circuit time constant, which without hydraulic reservoirs can be substantial. Alternatively, the availability of a local hydraulic power source can eliminate the need for subsea hydraulic accumulators.

Electrical energy generated can be stored in batteries and/or used to power subsea sensors and instrumentation and/or for heating purposes.

If sufficient electric power can be generated, then an all-electric subsea control system may be possible.

The availability of localized power at the seabed means that the electric and hydraulic ratings of the umbilical cable and therefore its physical diameter and weight can be reduced, which can significantly reduce the cost of the umbilical cable needed to carry electric and hydraulic power to the seabed equipment.

A reduced weight umbilical cable will be easier to handle and reduce the installation costs.

Embodiments of the present invention enable increased subsea functionality compared to conventional subsea systems.

Thus, while there has been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus for providing a source of power, the apparatus comprising:

a rotor having external blades for use in causing rotation of the rotor, and internal blades for use in propelling a fluid through the rotor during rotation of the rotor;

a fluid circuit coupled with the rotor, wherein rotation of the rotor propels fluid in the fluid circuit through the fluid circuit;

a power device configured to use the fluid propelled through the fluid circuit as a power source;

wherein the rotor is in a flow path for a second fluid, the rotor being rotatable by the flow of the second fluid through the path;

a stator in the rotor, such that the first fluid can be propelled between the rotor and the stator;

wherein the stator has a plurality of external blades interleaved with the internal blades of the rotor so that rotation of the rotor causes the fluid to be propelled between the internal and external blades;

wherein the volume between adjacent internal blades of the rotor and external blades of the stator decreases in the direction in which the fluid is propelled between the rotor and the stator; and wherein the rotor is in a flow path for hydrocarbon fluid in a subsea hydrocarbon well facility, the power device using the fluid propelled through the circuit as a power source for the well facility.

2. The apparatus according to claim 1, wherein the power device is configured to use the fluid propelled through the circuit as a power source to hydraulically operate at least one hydraulic device.

3. The apparatus according to claim 1, wherein the power device configured to use the fluid propelled through the circuit as a power source generates electrical power from fluid propelled through the fluid circuit.

4. The apparatus of claim 1, wherein a length of the internal blades of the rotor and the external blades of the stator decrease in the direction in which fluid is propelled between the rotor and the stator.

5. A method of propelling a first fluid, the method comprising:

providing a rotor having external blades and internal blades; and coupling a fluid circuit with the rotor;

causing rotation of the rotor via the external blades to propel the first fluid through the rotor during rotation of the rotor;

causing further rotation of the rotor by a second fluid, wherein the rotor is in a flow path with the second fluid;

propelling the first fluid between the internal blades of the rotor and external blades of a stator, wherein the external blades of the stator comprise a plurality of external blades interleaved with the internal blades of the rotor;

wherein the volume between adjacent internal blades of the rotor and external blades of the stator decreases in the direction of the first fluid being propelled between the internal blades and external blades;

wherein the flow path is a flow path for hydrocarbon fluid in a subsea hydrocarbon well facility, the first fluid propelled through the circuit being used as a power source for the subsea hydrocarbon well facility.

6. The method according to claim 5, wherein the propelled fluid is used for hydraulically operating at least one hydraulic device.

7. The method according to claim 5, wherein the propelled fluid is used for generating electrical power.

8. The method claim 5, wherein a length of the internal blade of the rotor and the external blades of the stator decrease in the direction in which fluid is propelled between the rotor and the stator.

* * * * *